US005227744A

United States Patent [19]

Sabatier

[11] Patent Number: 5,227,744

[45] Date of Patent: Jul. 13, 1993

[54] TRANSITION ELEMENT BETWEEN ELECTROMAGNETIC WAVEGUIDES, NOTABLY BETWEEN A CIRCULAR WAVEGUIDE AND A COAXIAL WAVEGUIDE

[75] Inventor: Christian Sabatier, Nice, France

[73] Assignee: France Telecom, Paris, France

[21] Appl. No.: 730,663

[22] Filed: Jul. 16, 1991

[30] Foreign Application Priority Data

Jul. 20, 1990 [FR] France ..... 90 09550

[51] Int. Cl.[5] ..... H01P 1/16

[52] U.S. Cl. ..... 333/21 R; 333/26; 333/34

[58] Field of Search ..... 333/21 R, 26, 34

[56] References Cited

U.S. PATENT DOCUMENTS

| | | | |
|---|---|---|---|
| 2,207,845 | 7/1940 | Wolff | 333/34 |
| 2,981,904 | 4/1961 | Ajioka et al. | 333/34 |
| 3,594,663 | 7/1971 | Allen | 333/26 X |
| 4,092,991 | 2/1990 | Ishikawa et al. | 333/26 |

FOREIGN PATENT DOCUMENTS

| | | | |
|---|---|---|---|
| 1122116 | 1/1962 | Fed. Rep. of Germany | 333/33 |
| 1113863 | 9/1984 | U.S.S.R. | 333/26 |

OTHER PUBLICATIONS

P. J. B. Clarricoats, "A Broad-Band Waveguide Junction Containing Dielectric", IEEE Proceedings Mongoraph No. 437E, Apr. 1961.

Wolfgang, J. R. Hoefer, et al., "Optimal Waveguide to E-Plane Circuit Transitions with Binomial and Chevyshev Transformers", 14th European Microwave Conference Proceeding, Sep., 1984.

*Primary Examiner*—Robert J. Pascal
*Assistant Examiner*—Benny Lee
*Attorney, Agent, or Firm*—Locke Reynolds

[57] ABSTRACT

A transition element for electromagnetic waveguides of the type designed to provide for the transition between a circular waveguide and a coaxial waveguide, constituted by a circular external guide cooperating with an internal conductor forming an end portion of the central conductor of the coaxial waveguide, the internal conductor having at least one intermediate transition step with a substantially constant section throughout its length. The device can be applied notably to the making of two-band duplexers.

9 Claims, 2 Drawing Sheets

TRANSITION ELEMENT BETWEEN ELECTROMAGNETIC WAVEGUIDES, NOTABLY BETWEEN A CIRCULAR WAVEGUIDE AND A COAXIAL WAVEGUIDE

BACKGROUND OF THE INVENTION

1. Field of the Invention

The field of the invention is that of transition elements between electromagnetic waveguides.

In the field of microwave technology, waveguides are elements that provide for the guided transmission of an electromagnetic signal, for example between a source and a radiating element. The most widely used microwave transmission elements are the rectangular guide, the circular guide and the coaxial guide.

Transition elements are elements that are interposed simply between two guides of different types to obtain a change in transmission technology. Thus, there are transition elements that can be used to change from rectangular guide to coaxial guide technology, from rectangular guide to circular guide technology, from circular guide to coaxial guide technology, and vice versa.

The most frequently used transitions are those that enable changing from rectangular or circular guide technology to coaxial guide technology.

Circular guides are preferably used in certain frequency bands, because they have notable advantages. They are easier to make than rectangular waveguides, and their circular configuration enables them to be used as rotating joints (notably in the field of rotary antennas used for air and maritime surveillance) mechanically dissociating a fixed assembly from a movable assembly without creating any discontinuity in the guided propagation.

An object of the present invention is precisely the transitions between circular electromagnetic waveguides and coaxial electromagnetic waveguides.

2. Description of the Prior Art

In a known way, the passage from a circular guide to a coaxial guide is achieved of an internal conductor with a conical form as shown in FIG. 2, or more generally, with a form progressively radially extending and without transition step.

FIG. 2 shows a longitudinal section of a transition between a circular guide and a coaxial guide.

An electromagnetic wave gets propagated along a direction 24 in a circular guide 21 to which there is connected a transition 22 with a radius A having, at its center, a conical conductor 20. The conical conductor 20 constitutes an end of a circular conductor 23 with a radius B forming the central conductor of a coaxial guide 25. The transition 22 constitutes an end of a coaxial waveguide 25. The coaxial guide 25 is constituted by two conductors 23, 26 with outer radius A and inner radius B and a dielectric 27 enabling the internal conductor 23 to be placed coaxially within the external guide 26. The dielectric may either completely fill the section between the internal conductor 23 and the external guide 26 throughout the length on which the coaxial guide extends, or it may consist of thin round wafers of dielectric spaced out from one another and positioned evenly along the coaxial guide. Naturally, the dielectric chosen should not disturb the wave transmission that is carried out.

The gradual transition 22 is characterized by an angle $\alpha$. Usually, the value of the angle $\alpha$ is between 7 and 10 degrees, depending on the passband and on the standing wave ratio (SWR) desired. The relationships between the SWR, the passband and the angle $\alpha$ are such that the angle $\alpha$ should be small if a high passband or a low SWR (little mismatching, major level of transferred power) is desired.

Thus, so that the transitions made do not excessively restrict the passband and do not prompt excessive reflections due to mismatching, it is necessary to choose a small angle $\alpha$, for a constant radius B of the central conductor, whence the relatively large transition length 22.

A large transition length is no negligible drawback, especially when no compromise can be accepted on the transmission characteristics. Thus, to preserve a suitable cut-off frequency and passband, it is not always possible to reduce the radius B of the central conductor 23 to diminish the length of the transition 22.

Besides, the longer the transition 22, the greater is the effect of its weight. This is a major drawback, notably when a transition 22 such as this has to form part of a device mounted on a satellite.

Another drawback of known transitions is that the end 28 of the conical part 20 of the central conductor 23 should absolutely be placed at the center of the circular waveguide 21 so as not to excite undesired modes, especially the TEM (transverse electrical magnetic) mode of the coaxial waveguide 25 which can get propagated irrespectively of the transmission frequency.

SUMMARY OF THE INVENTION

The present invention is aimed, in particular, at overcoming these drawbacks.

More precisely, a first aim of the present invention is to implement a transition element between a circular electromagnetic waveguide and a coaxial electromagnetic waveguide with a smaller length and mass than that of existing transitions, for equivalent passband and matching.

A second aim of the invention, again, is to provide a transition element, such as this, that preserves the desired propagation mode or modes, and avoids the excitation of undesired modes. In particular, the invention does not seek to excite the TEM mode in the coaxial waveguide.

Yet another aim of the invention is to present a circular guide/coaxial guide transition element, the position of the central conductor of which is less critical than in the case of an end of a conical central conductor.

These aims, as well as others that shall appear here below, are achieved by means of a transition element for electromagnetic waveguides, of the type designed to ensure the transition between a circular waveguide and a coaxial waveguide, comprising a central conductor, said transition element comprising a circular external guide cooperating with an internal conductor forming an end portion of the central conductor of said coaxial waveguide, said internal conductor having at least one intermediate transition step with a substantially constant section throughout its length.

The use of such steps, instead of standard means with continuously variable sections, makes it possible to reduce the space factor of the transition by nearly 50% for equivalent passbands and for equivalent matching.

Advantageously, said internal conductor has essentially abrupt shoulders at both ends of each of said intermediate steps.

Thus, the problems of the centering of the internal conductor prove to be far less crucial.

The internal conductor may also have a conical or truncated leading edge.

Advantageously, the internal conductor is formed by a first end step with a circular section having an abrupt leading edge, a second step with a circular section, with a radius greater than the radius of said first end step, said second step having a first abrupt shoulder of connection with said first end step, and a second abrupt shoulder of connection with said central conductor of said coaxial waveguide.

According to a preferred mode of implementation of the present invention, the circular external guide has a narrowed section of its internal diameter at the level of said intermediate step or steps of said internal conductor.

Preferably, said narrowed section has a reduced diameter that is constant along a length centered substantially on the leading edge of the end of said internal conductor.

Advantageously, said internal conductor has two consecutive intermediate steps, and the narrowed section of said external guide extends approximately up to the median portion of the second intermediate step having a greater radius.

Preferably, the narrowed section has essentially abrupt shoulders at its two ends.

A particular application of the transition according to the invention lies in two-band duplexers.

BRIEF DESCRIPTION OF THE DRAWINGS

Other characteristics and advantages of the present invention shall appear from the following description of an advantageous embodiment of the present invention, given by way of a non-restrictive illustration, and from the appended drawings, of which.

DETAILED DESCRIPTION OF THE INVENTION

Figure 2:
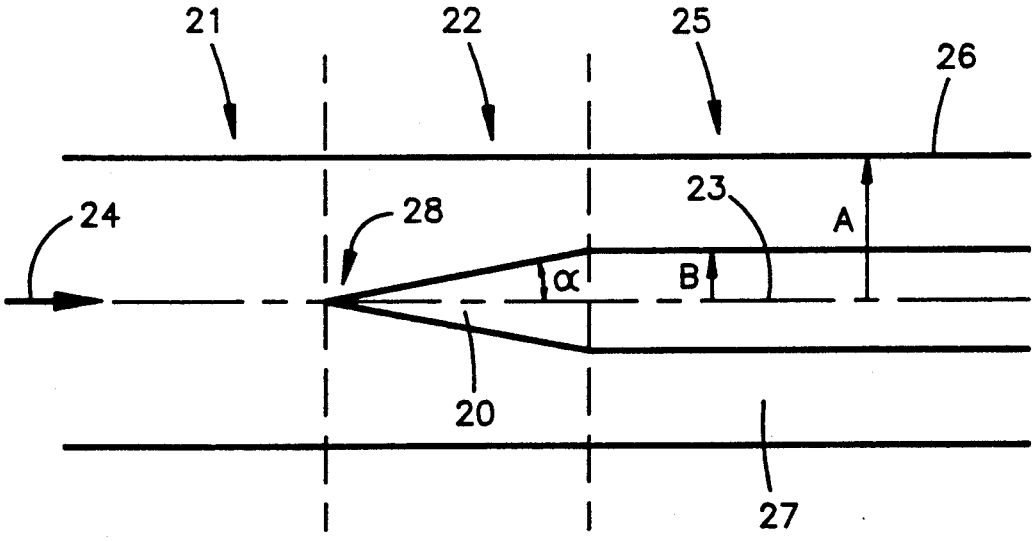
Fig. 2 PRIOR ART
FIG. 2 shows a longitudinal section of a transition between a circular guide and a coaxial guide of the existing type.

As described above, the known transitions are of the conical type as shown in FIG. 2, and are characterized by the value of the angle $\alpha$. The cut-off frequency of the coaxial guide 25 increases when the radii A or B decrease and when the ratio of the radii A/B decreases. Thus, the diminishing of the angle $\alpha$ leads to a greater transition length 22 if it is desired to preserve a reasonably low cut-off frequency and, hence, a big passband.

Figure 3:
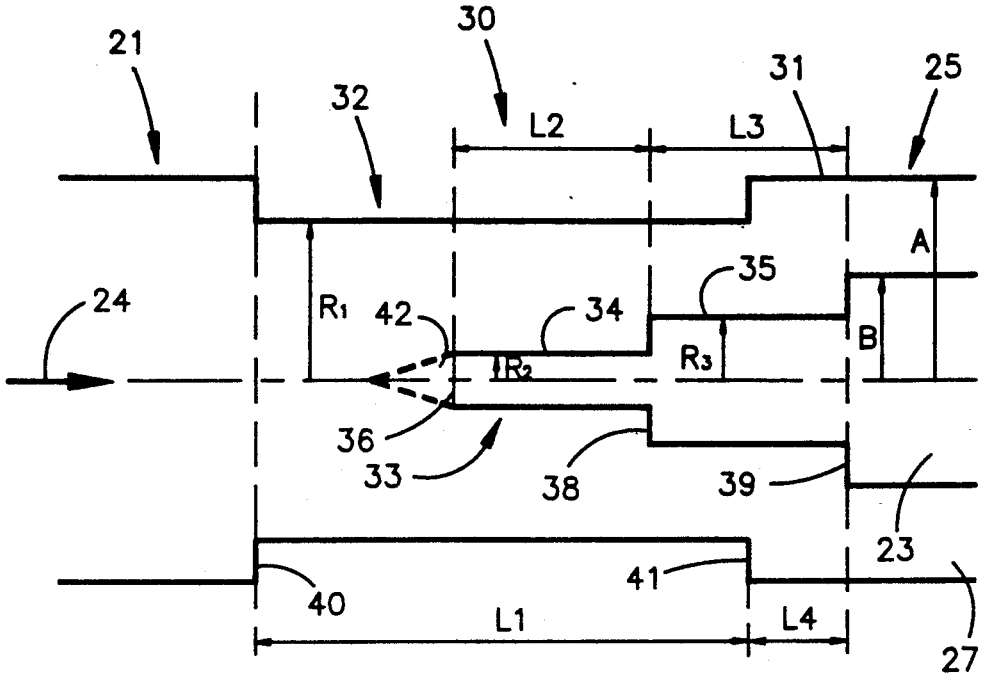
FIG. 3 shows a lateral section of a transition according to a particular embodiment of the present invention.

FIG. 3 shows a longitudinal section of a transition 30 between a circular guide 21 and a coaxial guide 25 according to a preferred embodiment of the present invention.

The transition 30 shown may be split up into two parts:

a circular external guide 31 with a radius A advantageously having a indented portion 32 or narrowed section, with a radius $R_1$ and a length $L_1$, enabling the electromagnetic field to be concentrated;

an internal guide constituted by a central conductor 33 formed by two steps 34, 35 having respective radii $R_2$ and $R_3$ and respective lengths $L_2$ and $L_3$ with an abrupt transition 38 between the steps 34 and 35 and a second abrupt transition 39 between the second step 35 and the central conductor portion with the biggest radius, this central conductor portion forming the end of the central conductor 23 of the coaxial guide 25.

The narrowed section 32 is demarcated by two shoulders 40 and 41 that are advantageously essentially abrupt. It is located at the intermediated steps 34, 35.

The leading edge 36 of the internal conductor 33 is advantageously abrupt and perpendicular to the direction of propagation 24 of the microwave. In this case, the position of the central conductor 33 is not as vitally important as when the leading edge 36 is conical or truncated. For, if the leading edge 36 of the central conductor 33 is conical or truncated, it is absolutely necessary to place the leading edge at the center of the waveguide 21, or else undesired propagation modes are excited: for example, the TEM mode of the waveguide may get propagated irrespectively of the frequency of the propagated signal.

It is, however, quite possible to use a leading edge 42 of the conical central conductor 33, the accurate positioning of the central conductor being, in this case, essential for efficient propagation of the microwave. The leading edge may also be truncated.

It is quite possible to envisage the use of an internal conductor 33 with a different number of steps 34, 35, as also the implementation of a different number of steps on the external guide at the transition 30. The number of steps is a function of the desired passband, and of the geometry of the circular waveguide 21 and coaxial waveguide 25. The addition of supplementary transitions leads to a greater length of the transition 30 without necessarily improving the SWR, as the relationship between the frequency and the propagation speed of the wave in the guide is not linear for the $TE_{11}$ mode because of the dispersion.

The leading edge 36 is preferably located approximately in the middle of the narrowed section, but another position of the leading edge 36 with respect to this section can be envisaged, depending on the transmission characteristics to be obtained.

Besides, according to a preferred embodiment of the present invention, the narrowed portion 32 of the external guide 31 extends approximately up to the median portion of the second step 35 with a radius $R_3$.

The transition 30 may either constitute an end of the coaxial guide 25 which, in this case, can be fixedly joined (by fastening means that are not shown) to the circular guide 21, or may be integrated into an integrally cast unit formed by the circular guide 21, the transition 30 and the coaxial guide 25.

In the case of a structure with a symmetry of revolution, only the $TE_{1X}(X \geqq 1)$ and $TM_{1X}(X \geqq 1)$ modes may be excited by a discontinuity for an excitation in $TE_{11}$ mode, in the direction 24. The dominant mode is therefore the $TE_{11}$ mode, and the first higher mode is the $TM_{11}$ mode in the two waveguides.

If we consider, for example, a circular guide with a radius A = 40 mm, its cut-off frequency is 2.198 GHz for the $TE_{11}$ mode and 4.574 GHz for the $TM_{11}$ mode. In the same way, a coaxial guide with radii of 14 mm and 40 mm for the central conductor and the external guide respectively has a cut-off frequency of 1.815 GHz for the $TE_{11}$ mode and 5.989 GHz for the $TM_{11}$ mode.

Thus, the propagation of the dominant $TE_{11}$ mode is theoretically possible for frequencies ranging from 2.198 GHz to 4.574 GHz. In practice, for the dispersion to be acceptable, the bottom cut-off frequency is slightly greater, of the order of 2.25 GHz. The passband therefore, in practice, has a value of 2.25 to 4.5 GHz if the transition element is not taken into account.

The passband is given by:

$(F_a-F_b)/F_b$, with $F_a$ the high passband frequency and $F_b$ the low passband frequency.

For a configuration of a known transition such as that shown in FIG. 2, in keeping to a passband of 50% (3 to 4.5 GHz), with a SWR of less than 1.12 (good matching of the transition), a size of the transition 22 of 100 mm is obtained for a ratio A/B=2.85 (A=40 mm and B=14 mm) and an angle $\alpha$ of 8 degrees. The passband is deliberately limited to 50% so as not to lower the SWR.

According to one embodiment of the invention, the following geometry is adopted:

$R_1$=38.72 mm;
$R_2$=5.94 mm;
$R_3$=10.3 mm;
$L_1$=52.48 mm;
$L_2$=21.19 mm;
$L_3$=22.66 mm;
$L_4$=2.07 mm;

$L_4$ being the distance between the shoulder connecting the second step 35 to the central conductor 23 and the step connecting the narrowed section 32 of the external conductor 31 to the external conductor 23 with a greater radius. With these values, the following transmission characteristics are obtained:

equivalent passband (from 3 GHz to 4.5 GHz, namely 50%);

SWR lower than 1.12, namely of equivalent value.

It is therefore seen that the transition 30 according to the embodiment described has the same passband and SWR characteristics as a transition 22 as shown in FIG. 2, with equal input guide (circular guide 21) and output guide (coaxial guide 25) geometries.

The main advantage of the present invention, in this example, is that the length of the transition 30 having the above-mentioned characteristics is only 54.55 mm ($L_1+L_4$), giving a gain of 45.45% in space factor. By analogy with standard transitions, this length corresponds to an angle $\alpha$ of 14.45 degrees. In this case, the passband no longer has a value of more than 25% only for an SWR of less than 1.12, which shows the usefulness of using a "compact" transition 30 according to the invention. The SWR remains the same irrespectively of the direction of propagation of the microwave (from the circular guide towards the coaxial guide or from the coaxial guide towards the circular guide).

Furthermore, since the transition 30 is shorter, its mass is smaller than that of known transitions. This favors the use of a "compact" transition such as this in a device working in a satellite.

Naturally, additional steps may be added on and the dimensions of the various discontinuities (steps of the internal conductor, indentation of the external guide, etc.) may be modified, depending on the result to be obtained (passband, SWR etc.).

It is also possible to envisage the making of the connection between the successive steps 34, 35 by slanted shoulders, with the steps naturally remaining parallel to the direction 24 of propagation of the electromagnetic wave.

Figure 4:
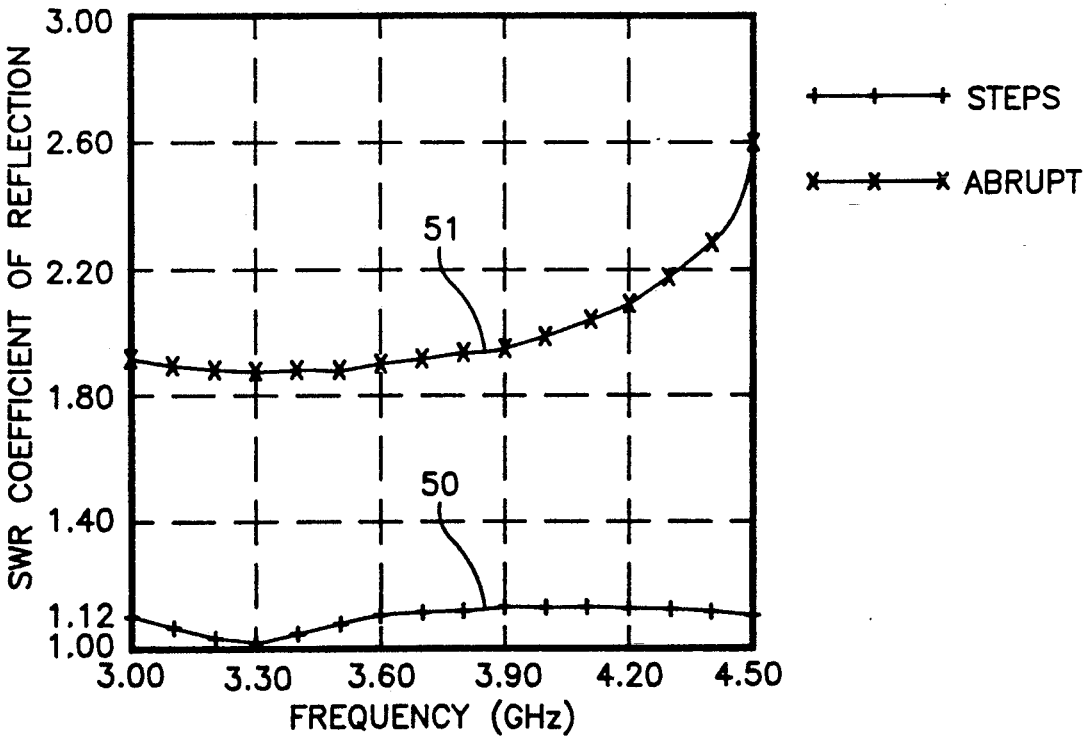
FIG. 4 shows the development of the SWR for transmission frequencies ranging from 3 GHz to 4.5 GHz, for a transition according to the invention and an abrupt transition.

FIG. 4 shows the development of the SWR for the $TE_{11}$ transmission mode, for a transition according to the invention and an abrupt transition.

The transmission frequency in x-axis values varies from 3 GHz to 4.5 GHz (50% of the passband in $TE_{11}$ mode).

The characteristic 50 represents the variation of the SWR in the case of a "compact" stepped transition according to the invention between a circular guide and a coaxial guide. The previous dimensions of the lengths and of the radii are adhered to. It is observed that, for a 50% passband, the SWR remains lower than 1.12, irrespectively of the transmission frequency, and notably passes through a minimum in the region of 3.3 GHz.

The characteristic 51 is that of an abrupt transition between the same guides as above: the external radius of the coaxial waveguide is 40 mm and the radius of the circular guide too. The radius of the internal conductor of the coaxial guide is 14 mm and this conductor has a truncated end. The characteristic 51 has a SWR constantly greater than 1.9. It is at a minimum in the region of 3.4 GHz, and the SWR increases considerably when the frequency goes beyond 4 GHz.

These results clearly show the advantage of using a "compact" transition with steps according to the present invention.

A particular application of the transitions between circular guides and coaxial guides lies notably in the making of two-band duplexers and bi-polarizations. The invention can notably be applied to a two-band duplexer as shown schematically in FIG. 1, using a transition between a circular guide and a coaxial guide.

Figure 1:
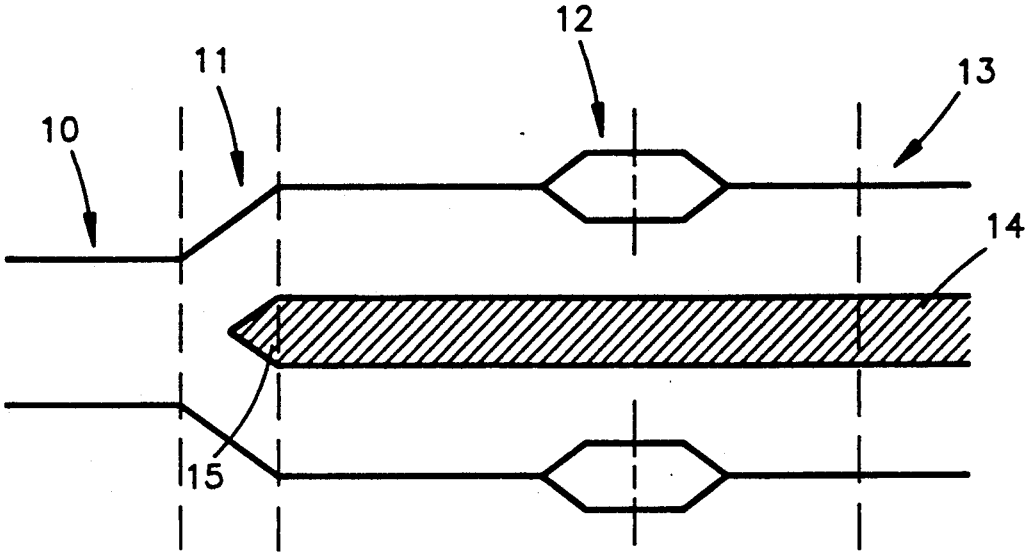
FIG. 1 is a schematic drawing of a two-band duplexer using a transition between a circular guide and a coaxial guide.

As shown in FIG. 1, a device such as this has a circular guide 10, fixedly joined to a transition 11, followed by a set of two duplexers 12 and then a coaxial guide 13. The coaxial guide 13 has, at its center, a conductive element 14 which extends all along the coaxial guide, and its end 15 is located in the transition zone 11. The coupling of the duplexers part with waveguides (not shown) is done by symmetrical slots.

As a general rule, the horizontal or vertical polarization is not identical in the two frequency bands.

The excitation of the high band is done by means of a circular waveguide excited in $TE_{11}$ mode. The two polarizations may exist, depending on the excitation of the $TE_{11}$ mode, in the circular waveguide.

For the low band, the excitation is done by coupling by means of a slot between a rectangular guide and the coaxial guide. It is necessary to use two symmetrical slots to excite the $TE_{11}$ mode of the coaxial guide. The excitation of the TEM mode which gets propagated irrespectively of the geometry of the guide and the working frequency cannot be done in this way. The separation of the rectangular waveguide (not shown) into two identical rectangular guides for the excitation by symmetrical slots is done by means of a Tee.

It is also possible to obtain the two polarizations according to the position of the two symmetrical guides. In order that there should be propagation of the wave towards the radiating element and not towards the circular guide 10, the radius of the circular guide 10 should constitute a short-circuit for all the frequencies of the low band.

The value of a duplexer such as this as compared with a duplexer having an output in circular guide form is that the passband is greater in the case of the coaxial guide. The appearance of the higher modes is done at higher frequencies in a coaxial guide than in a circular guide, provided that the radii of the two conductors of the coaxial guide (internal and external conductors) is chosen appropriately. In this case, the spacing in frequency between the two bands may then be greater.

In the implementation of the "compact" transition technology of the invention, the stepped transition enables a low SWR to be obtained, and the two-band duplexer used therefore does not call for any matching in principle. A "compact" transition 30 of the type of the invention can be applied in many fields, notably in that of the duplexers and, generally, whenever it is necessary to pass from a circular waveguide transmission to a coaxial guide transmission and vice versa.

What is claimed is:

1. A transition element for electromagnetic waveguides providing for the transition between a circular waveguide having a first circular conductor and a coaxial waveguide comprising a second circular conductor and a central conductor extending along a longitudinal axis, the central conductor having a predetermined radius, said transition element comprising:

a circular external conductor having a first axial extremity configured to attach to said first circular conductor and a second axial extremity configured to attach to said second circular conductor; and an internal conductor having a first and second axial limit, the first axial limit of said internal conductor being attached to said central conductor of said coaxial waveguide, said internal conductor having at least one step, each said step having a first end and a second end spaced along said longitudinal axis, with one of the first and second ends of each step connected to one of the first and second ends of another step, the steps being interconnected to lie along said longitudinal axis, with each said step having a substantially constant cross-section and having a corresponding radius smaller than said predetermined radius of said central conductor.

2. A transition element according to claim 1, wherein both ends of each said step of said internal conductor has abrupt shoulders, the abrupt shoulders being substantially perpendicular to said longitudinal axis.

3. A transition element according to claim 1, wherein said internal conductor includes a conical portion having a base end and a point end, the base end being attached to one of said first and second ends of one of said at least one step, the point end being aligned along said longitudinal axis.

4. A transition element according to claim 3, wherein said point end is truncated.

5. A transition element according to claim 1 wherein said circular external conductor of the transition element has a narrowed cross-section portion with a diameter which is substantially smaller than a corresponding diameter of said first and second circular conductors.

6. A transition element according to claim 5, wherein said internal conductor has a first step having a constant circular cross-section of a first radius and a second step having a constant circular cross-section of a second radius greater than the first radius, one of said first and second ends of said second step corresponding to said first axial limit of said internal conductor and one of said first and second ends of said first step corresponding to said second axial limit of said internal conductor, and wherein said narrowed cross-section of said external conductor extends approximately from said first axial extremity up to a median portion of the second intermediate step.

7. A transition element according to claim 1, wherein said internal conductor comprises a first step having a circular cross-section of a first radius and a second step having a circular cross-section of a second radius greater than the first radius of said first end step, a first abrupt shoulder connecting the second step with said first step, and a second abrupt shoulder connecting the second step with said central conductor of said coaxial waveguide.

8. A transition element for electromagnetic waveguides providing for the transition between a circular waveguide having a first circular conductor and a coaxial waveguide having a central conductor and a second circular conductor, said central conductor extending along a longitudinal axis and having a predetermined radius, said transition element comprising:

a circular external conductor having a first axial extremity configured to attach to said first circular conductor and a second axial extremity configured to attach to said second circular conductor; and an internal conductor having a first and a second axial limit, the first axial limit being attached to said central conductor of said coaxial waveguide, and having at least two interconnected steps extending in the direction of said longitudinal axis, each of the steps having a first end and a second end, each of the steps having a substantially constant circular cross-section of a corresponding radius smaller than said predetermined radius of said coaxial waveguide central conductor.

9. A transition element for electromagnetic waveguides providing for the transition between a circular waveguide having a first circular conductor and a coaxial waveguide having a central conductor of a predetermined radius extending along a longitudinal axis and a second circular conductor, said transition element comprising:

a circular external conductor having a first axial extremity configured to attach to said first circular conductor and a second axial extremity configured to attach to said second circular conductor; and an internal conductor having a first and a second axial limit, the first axial limit configured to attach to said central conductor of said coaxial waveguide, the internal conductor comprising a first and a second step, each step having first and second axially separated ends, each step having a substantially constant circular cross-section of a corresponding radius smaller than said predetermined radius of said central conductor of said coaxial waveguide, the radius of the first step being smaller than the radius of the second step to define an abrupt shoulder connecting the first and the second steps.

* * * * *